United States Patent [19]

Kostos et al.

[11] Patent Number: 4,998,382

[45] Date of Patent: Mar. 12, 1991

[54] INSULATED REFRIGERATOR DOOR ASSEMBLY WITH SUBSTANTIALLY ALL GLASS FRONT DOORS

[75] Inventors: Jeffery Kostos; Melvin Kaspar, both of La Grange Park; Paul Artwohl, Flossmoor, all of Ill.

[73] Assignee: Ardco, Inc., Chicago, Ill.

[21] Appl. No.: 448,328

[22] Filed: Dec. 11, 1989

[51] Int. Cl.[5] ..... E06B 3/00

[52] U.S. Cl. ..... 49/501; 49/504; 49/DIG. 1; 52/397

[58] Field of Search ..... 49/501, 504, DIG. 1, 49/400, 401, 402, 478; 52/397, 398, 789, 790, 208, 788, 821; 156/100

[56] References Cited

U.S. PATENT DOCUMENTS

| | | | |
|---|---|---|---|
| 1,805,969 | 5/1931 | Boström | 156/100 X |
| 2,205,522 | 6/1940 | Fix | 52/398 X |
| 2,834,999 | 5/1958 | Taylor et al. | 52/398 X |
| 3,499,245 | 3/1970 | Winsler et al. | 49/504 X |
| 3,971,178 | 7/1976 | Mazzoni et al. | 52/790 X |
| 3,975,881 | 8/1976 | Niyowski, Jr. | 49/DIG. 1 |
| 4,138,284 | 2/1979 | Postupack | 156/100 |
| 4,514,948 | 5/1985 | Meigs et al. | 52/397 |
| 4,604,840 | 8/1986 | Mondon | 52/788 X |
| 4,637,167 | 1/1987 | Svensson | 49/501 X |
| 4,719,728 | 1/1988 | Eriksson et al. | 52/790 X |
| 4,741,127 | 5/1988 | Bockwinkel | 49/501 |
| 4,817,335 | 4/1989 | Adell | 49/462 |
| 4,825,609 | 5/1989 | Rundo | 52/397 X |
| 4,831,780 | 5/1989 | Bockwanker | 49/DIG.1 |
| 4,852,303 | 8/1989 | Rolek | 49/478 X |
| 4,873,803 | 10/1989 | Rundo | 52/397 X |
| 4,948,206 | 8/1990 | Fitzpatrick | 49/402 X |

*Primary Examiner*—Philip C. Kannan
*Assistant Examiner*—Jerry Redman
*Attorney, Agent, or Firm*—Leydig, Voit & Mayer

[57] ABSTRACT

A multi-pane insulated glass door assembly in which the forward pane of the glass unit extends outwardly a greater than the panes rearwardly thereof and is supported by an outer metal frame having a relatively narrow forwardly extending perimeter portion adjacent the peripheral edge of the forward glass pane so as to provide the door with a modernistic, substantially all glass front appearance. In the illustrated embodiment, the outer metal frame has a rear portion extending inwardly behind the forward glass pane and a moulding is interposed between the forwardly extending perimeter portion of the metal frame and the peripheral edge of the forward glass pane to provide a finished appearance. A dark ink is affixed to an inside peripheral face of the forward glass pane for masking the peripheral components of the door assembly from sight through the forward glass pane from the front side thereof.

33 Claims, 2 Drawing Sheets

FIG. 3
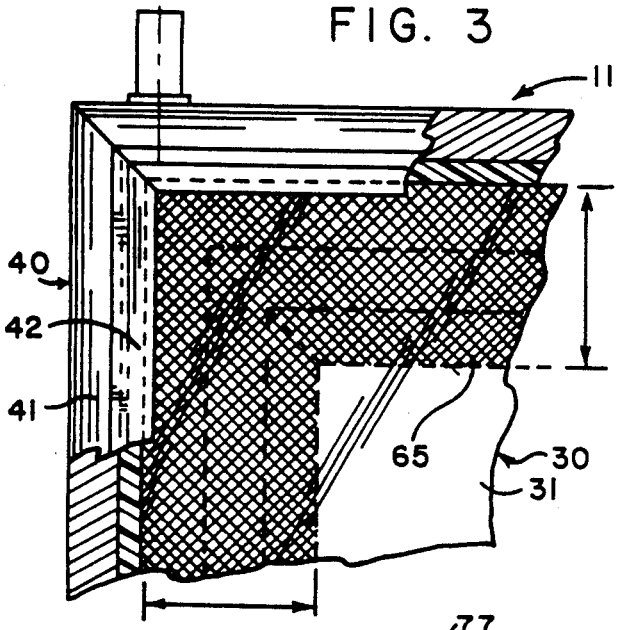
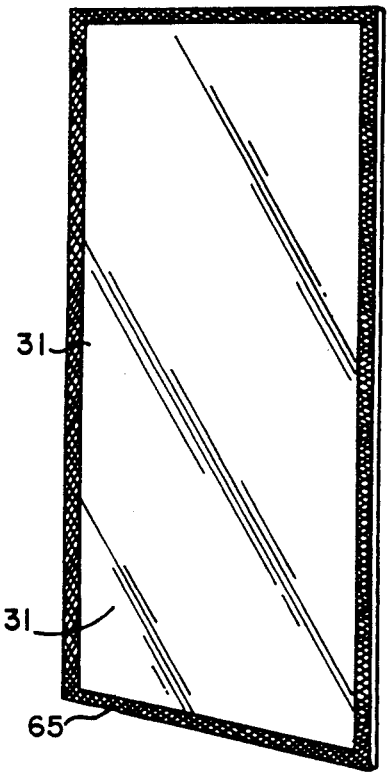
FIG. 4
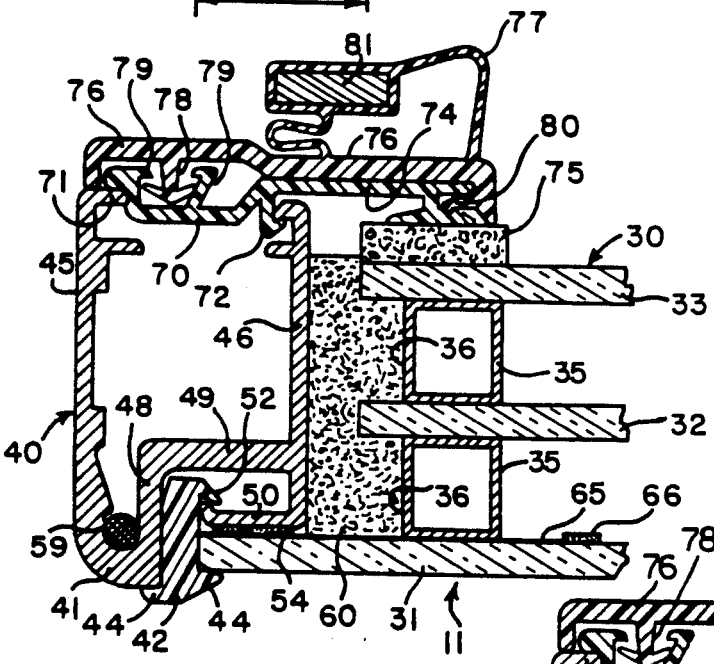
FIG. 5
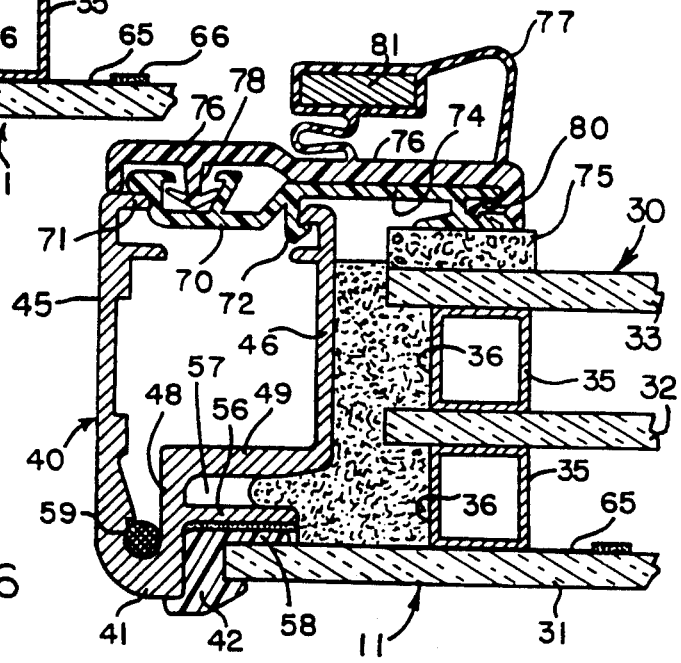
FIG. 6

INSULATED REFRIGERATOR DOOR ASSEMBLY WITH SUBSTANTIALLY ALL GLASS FRONT DOORS

DESCRIPTION OF THE INVENTION

The present invention relates generally to insulated glass doors, and more particularly, to multi-pane insulated glass door assemblies such as used in commercial refrigeration and freezer units.

For nearly thirty years, insulated glass door assemblies for commercial refrigerator and freezer insulations have comprised an insulated glass unit made up of two or more glass panes maintained in space-apart relation by tubular spacers with the interior between the panes appropriately sealed. The glass unit in turn is supported within a relatively rugged outer metallic frame, commonly formed from aluminum extrusions, with the metal frame overlapping the periphery of the glass unit for retaining the glass unit in position and for providing a decorative finished appearance to the door assembly. While improvements in energy efficiencies, structural rigidity, and mounting of such door assemblies have taken place over the years, such insulated glass door assemblies have remained substantially unchanged in their outer appearance. Although the desire for style changes has existed, cost considerations usually have prevented product changes.

Because of increasing customer demand for styling changes, manufacturers, particularly in Europe, recently have introduced more modernistic appearing glass door assemblies. These doors have included a single, relatively thick pane which provides the appearance of an all-glass, relatively contemporary, front to the door assembly. While such doors are attractive in appearance, they do not have the efficiency, safety, and durability features the industry has grown to expect in commercial insulated refrigerator door assemblies and have been unable to withstand the relatively abusive use in commercial establishments where doors are repeatedly opened and closed and are frequently struck by shopping carts and the like.

It is an object of the present invention to provide an insulated refrigerator door assembly which has a modernistic, stylized appearance, but which retains the efficiency and structural features to which the industry has grown accustom over the years.

Another object is to provide an insulated glass door assembly as characterized above which has a substantially all-glass contemporary front appearance.

A further object is to provide an insulated glass door assembly of the above kind which has an appearance that is distinct from conventional refrigerator glass door assembly over the years, but which is constructed in substantially similar manner, and hence, lends itself to economical manufacture by existing production techniques.

Other objects and advantages of the invention will become apparent upon reading the following detailed description and upon reference to the drawings, in which:

FIG. 3 is an enlarged partial plan view of a corner of one of the doors of the illustrated assembly with portions broken away;

FIG. 4 is a perspective of a rear side of the forward glass pane of one of the doors;

FIG. 5 is an enlarged fragmentary section of one of the door of the illustrated assembly; and, FIG. 6 is an enlarged fragmentary section, similar to FIG. 5, but showing an alternative embodiment of door construction.

Figure 1:
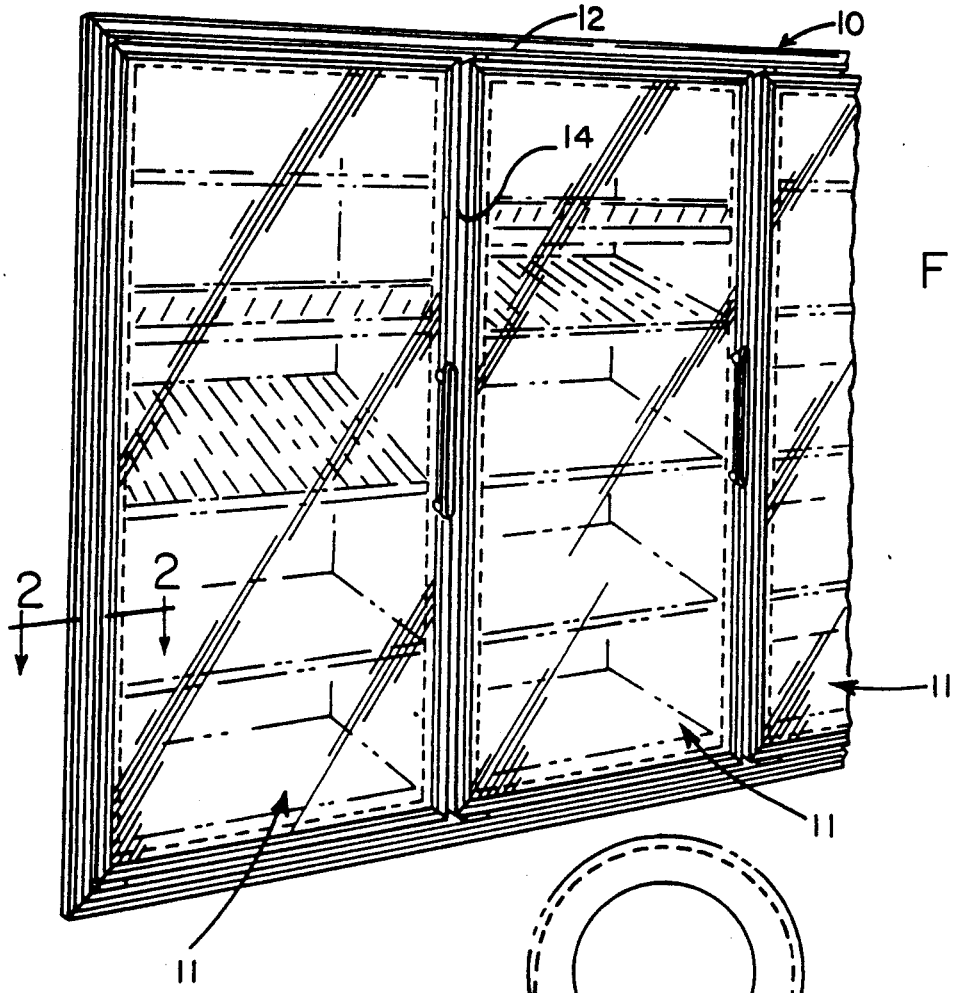
FIG. 1 is a perspective of a refrigerator door assembly having a plurality of insulated glass doors embodying the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

Referring now more particularly to the drawings, there is shown an illustrative refrigerator door assembly 10 comprising a plurality of insulated glass doors 11 embodying the present invention each mounted for swinging movement in a door mounting cabinet frame 12, which in turn is mounted within an opening in a front wall 13 of a refrigerator cabinet or the like. It will be understood that the door assembly 10 is particularly adapted for use in free standing refrigerator or freezer cases or built-in coolers or cabinets of the type used in supermarkets and other retail stores to display refrigerated or frozen merchandise. The door mounting frame 12, which may be of a conventional construction, extends about the periphery of the opening in the wall 13 and includes a plurality of mullions 14 that extend vertically between the top and bottom perimeters of the frame to provide rigidity for the frame 12 and define sealing surfaces against which the free swinging sides of the doors 11 engage when in a closed condition.

The cabinet frame 12 includes a plurality of frame members 15, preferably in the form of extrusions made of aluminum or other suitable metal material, arranged in a rectangular configuration about the periphery of the cabinet opening. The illustrated frame members 15 have a generally Z-shaped configuration comprising a front flange 16, a rear flange 18, and a web 19 extending therebetween. The front and rear flanges 16, 18 project in opposite directions, generally at right angles to the web 19. The rear flange 18 defines a plurality of channels 20 which are adapted to receive one or more electrical heating cables 21 for the purpose of maintaining the extrusion at a temperature sufficient to avoid a build up of condensation. An appropriate insulating material 23 also may be provided. The rear flange 18 has a removable cover plate 22 which encloses the channels 20 and provides a sealing surface against which the doors close. An insulating strip 24, preferably made of plastic, is interposed between the frame member web 19 and the cabinet wall 13 and in this case also encompasses a rear side of the flange 18. For illuminating the interior of the cabinet, a light fixture 25 may be mounted on the flange 18 in rearwardly extending fashion.

The insulated glass doors 11 each include an insulated glass unit 30 comprising a plurality of glass panes, 31, 32, 33, disposed in parallel side-by-side relation with a spacer 35 interposed between adjacent panes. The illustrated glass unit 30 includes a forward plane 31 disposed on the front or ambient air side of the door, a rear plane 33 disposed on the rear or refrigerated side of the door, and an intermediate pane 32 disposed between the forward and rear panes 31, 33. As is known in the art, each spacer 35 may comprise a plurality of elongated metal tubular members disposed in a rectangular arrangement between the respective adjacent glass panes, and in this case, each spacer is located inwardly a distance from the peripheral edges of the glass panes so as to define outwardly opening channel areas 36 about the perimeter of the glass unit 30. An appropriate sealant preferably is provided between the sides of the spacers 35 and the adjacent glass panes 31, 32, 33 for establishing a primary vapor seal. For supporting the glass unit 30, each door 11 has an outer metal frame 40, preferably assembled from a plurality of extrusions made of aluminum or other suitable metal, which are disposed about the periphery of the glass unit 30 and joined together by suitable corner keys as is known in the art.

In accordance with the invention, the forward pane of each door extends substantially to the outer perimeter of the door for providing a modernistic, substantially all-glass front appearance to the door. To this end, the outer metal frame 40 has a relatively small-sized, forward perimeter portion 41 extending into the plane of the forward glass pane 31 in close outwardly spaced relation to the peripheral edge thereof and a moulding 42 is interposed in slightly overlapping relation between the outer peripheral edge of the forward glass pane 31 and the forward metal frame portion 41 for filling the space therebetween and for providing a relative smooth finished appearance to the front side of the door. The forward metal frame perimeter portion 41 in this instance extends outwardly a relatively small distance beyond the plane of the front face of the forward glass pane 31 and the moulding 42 has a forward, relatively flat head portion with lips 44 overlapping respective peripheral edge portions of the forward glass pane 31 and the forward metal frame portion 41. From a front perspective, the door 11 has a flat substantially all-glass front appearance with the forward glass pane 31 extending outwardly substantially to the outer perimeter of the door, in distinct contrast to conventional commercial refrigerator doors in which the outer metal frame significantly overlaps the front face of the forward glass pane to provide a decorative trim about the door.

In carrying out the invention, the forward glass pane 31 extends outwardly a distance greater than the intermediate and rear planes 32, 33 and the metal door frame 40 has a rear portion extending inwardly behind the forward glass pane 31 in outwardly spaced relation the outer peripheral edges of the intermediate and rear panes 32, 33. As best shown in FIG. 5, the metal frame 40 in this case has a rearwardly opening channel shape with outer and inner side walls 45, 46 disposed in parallel relation to each other. The outer side wall 45 is located in outwardly spaced relation to the periphery glass unit 30 and forms one side of the forwardly extending frame perimeter portion 41, which in this instance has a general U-shaped configuration, the other side 48 of which is connected to the inner side wall 46 by a transverse wall 49 located rearwardly of the rear face of the forward glass pane 31.

The inner side wall 46 of the metal frame 40 in this instance is formed with an outwardly extending flange 50 in closely adjacent parallel relation so the rear face of the forward glass pane 31 and extends to the peripheral edge of the forward glass pane 31. The terminal end of the flange 50 and the side 48 of the perimeter portion 41 define an opening through which the moulding 42 extends. The moulding 42 in this case has a rear inwardly extending lip 52 that is engageable with the terminal end of the flange 50 for retaining the moulding in a mounted position. A foam adhesive tape 54 is interposed between the forward side of the flange 50 and the rear face of the forward glass pane 31. It will be appreciated by one skilled in the art that the flange 50 also may serve as a screw top to prevent fastening screws utilized in securing corner key elements in the outer metal frame from engaging and possibly damaging the forward glass pane 31. Alternatively, as shown in FIG. 6, the side 48 of the frame perimeter portion 41 may be formed with an inwardly extending flange 56 disposed in rearwardly spaced relation to the rear face of the forward glass pane 31 and the moulding 42 may be formed with a rear L-shaped leg 58 retained between the flange 56 and forward glass pane 31. An electrical heating wire 59 may be provided in the frame perimeter portion 41 in a passageway between the sides 45, 48, if necessary.

For retaining the glass unit 30 within the outer metal frame 40, the area between the spacers 35, the frame side wall 46, and the rear face of the forward glass pane 31 is filled with an adhesive 60, such as polysulfide. The ends of the glass panes protruding beyond the spacers 35 enhance securement of the glass unit by the adhesive 60. In the embodiment of FIG. 6, the adhesive extends into a channel 57 defined between the transverse wall 49 and the flange 56.

Figure 2:
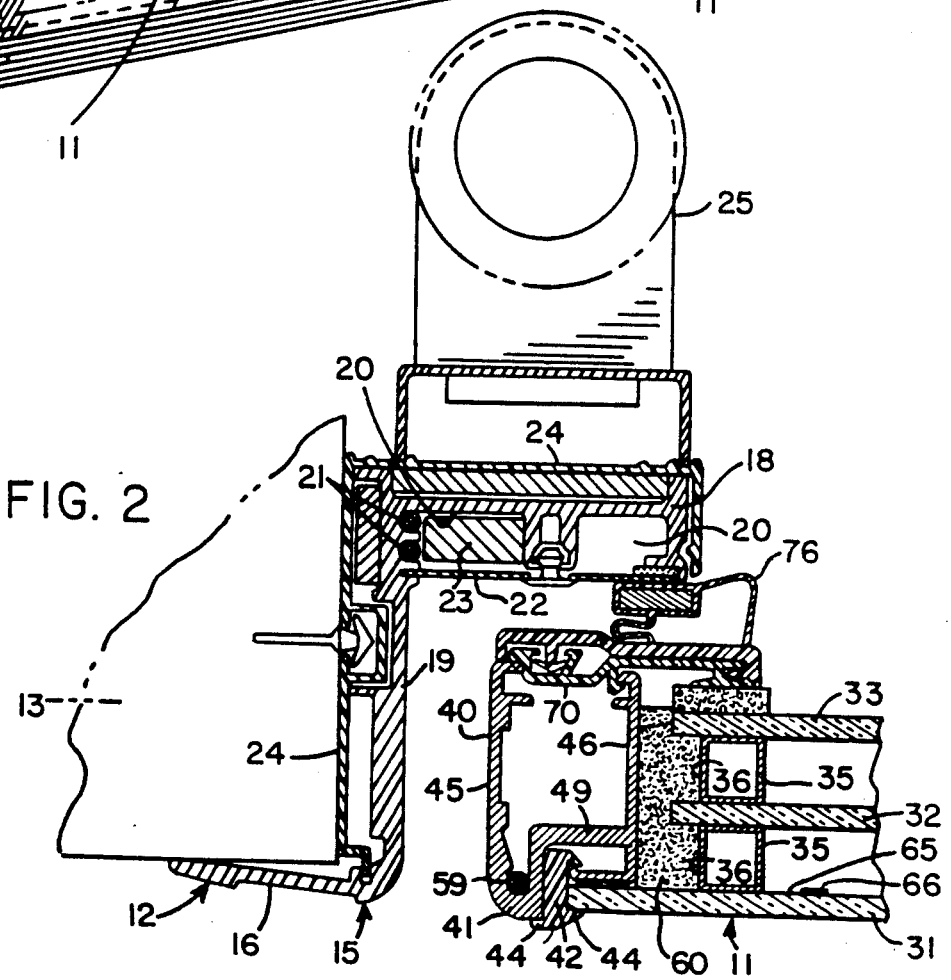
FIG. 2 is an enlarged fragmentary section taken in the plane of line 213 2 in FIG. 1.

In carrying out a further aspect of the invention, peripheral masking means is provided on the inner face of the forward glass pane for preventing viewing of the inner components of the door assembly through the forward glass pane from the front side thereof. In the illustrated embodiment, the masking is in the form of a dark silkscreen or ink 65 applied to the inner face of the forward glass pane 31 about its periphery, as shown in FIGS. 2 and 4. The masking 65 preferably extends from the peripheral edge of the glass pane 31 inwardly beyond the spacers 35 a distance so as to cover from view the inner portion of the frame 40 behind the glass pane 31, the adhesive tape 54, the polysulfide adhesive 60, the spacers 35, and the sealant between the spacers 35 and the forward glass pane 31. The dark colored silkscreen or ink 65 has been found to effectively mask such inner door assembly components, while at the same time enhancing the modernistic substantially all-glass front appearance for the door. A silkscreen bar 66 also may be applied to the inner face of the forward glass pane 31 to facilitate heating of the forward pane by conventional means if required.

For enclosing of a rear side of the metal frame 40 and covering the juncture between the rear side of the glass unit 30 and the outer metal frame 40, a back moulding 70, preferably made of aluminum, is adapted for snap action engagement between inwardly turned flanges 71, 72 of the outer frame side walls 45, 46. The back moulding 70 has an inwardly extending leg 74 secured to a rear face of the glass pane 33 by means of a double sided cellular foam tape 75.

For providing a seal between the door 11 and cabinet frame 12 when the door is in a closed position, a gasket sealing strip 76 is secured to the rear side of the moulding 70. The illustrated sealing strip 76, as best shown in FIG. 5, is formed with a T-shaped anchor 78 that is positively retained within inwardly extending retaining members 79 of the moulding 70, and the inner end of the sealing strip 76 has a U-shaped retaining flange 80 adapted for positive engagement with an inner end of the moulding 70. The sealing strip 76 has a gasket portion 77 which contains magnets 81 for creating a magnetic attraction with the cabinet frame cover plate 22, which may be made of stainless steel or other suitable magnetic material.

From the foregoing, it can be seen that the refrigerator door assembly of the present invention has a modernistic, substantially all-glass front appearance, but retains the efficiency and structural features of conventional insulated glass doors to which the industry has grown accustom over the years. Since the door assembly may be constructed in a manner substantially similar to that of conventional doors, it lends itself to economical manufacture by existing production techniques.

We claim as our invention:

1. A refrigerator door assembly comprising a metal cabinet frame for mounting in an opening of a refrigerator cabinet, an insulated glass door mounted for pivotal movement relative to said cabinet frame, said door including a glass unit having a plurality of glass panes disposed in side-by-side relation including a forward glass pane and a rear glass pane, a spacer interposed between adjacent panes for maintaining said panes in parallel relation with an air space therebetween, and means sealing said air space from the outside environment;

an outer metal frame about the periphery of said glass unit for supporting the weight of said glass unit;

said metal frame having a forward perimeter portion in the plane of said forward glass pane disposed in outwardly spaced relation to the peripheral edge of said forward glass pane, said forward perimeter portion does not extend in front of said forward glass pane, thus for defining a forwardly opening space about the peripheral edge of said forward glass pane; and a moulding disposed within said space between said forward frame perimeter portion and the peripheral edge of said forward glass pane, said molding having a forward end extending over a front side of said frame perimeter portion and a front side of said forward glass pane for bridging and covering the space therebetween.

2. The refrigerator door assembly of claim 1 including masking means on an inside face of said forward glass pane about the periphery thereof for preventing viewing of said spacer through said forward glass pane from a front side thereof while permitting unobstructed viewing of the interior of the refrigerator cabinet within which said door assembly is mounted.

3. The refrigerator door assembly of claim 1 in which said metal frame has a rear portion extending inwardly behind the said forward glass pane, and said forward glass pane has masking means affixed to an inside face thereof about its periphery for preventing viewing of said spacer and said inwardly extending metal frame portion through said forward glass pane from a front side thereof while permitting unobstructed viewing of the interior of the refrigerator cabinet within which said door assembly is mounted.

4. The refrigerator door assembly of claim 3 in which said masking means is a silkscreen affixed to the inside face of said forward glass pane.

5. The refrigerator door assembly of claim 1 including an intermediate pane disposed between said forward and rear glass panes, and said forward glass pane extends outwardly a greater distance than said rear and intermediate glass panes.

6. The refrigerator door assembly of claim 1 including adhesive means between the said metal frame and the outer periphery of said glass unit for securing said glass unit within said metal frame.

7. The refrigerator door assembly of claim 6 in which said glass panes each have peripheral portions extending outwardly beyond said spacers which are retained by said adhesive.

8. The refrigerator door assembly of claim 6 in which said adhesive is polysulfied.

9. The refrigerator door assembly of claim 6 including a masking means affixed to an inside face of said forward glass pane about the periphery thereof for preventing viewing of said spacer and adhesive through said forward glass panes from a front side thereof while permitting unobstructed viewing of the interior of the refrigerator cabinet within which said door assembly is mounted.

10. The refrigerator door assembly of claim 1 in which said frame perimeter portion extends forwardly a small distance beyond the plane of the front face of said forward glass pane.

11. The refrigerator door assembly of claim 1 in which said metal frame has a rearwardly opening channel shape with outer and inner side walls disposed in parallel relation to each other.

12. The refrigerator door assembly of claim 11 in which said outer side wall is located in a plane in outwardly spaced relation to the outer periphery of said glass unit and forms one side of said forward frame perimeter portion, said forward frame perimeter portion having a generally U-shaped configuration with the other side thereof connected to the inner side wall by a transverse wall located rearwardly of the rear face of said forward glass pane.

13. The refrigerator door assembly of claim 11 including a sealing gasket supporting moulding engaging a rear side of said outer metal frame and enclosing said channel opening thereof.

14. The refrigerator door assembly of claim 13 in which said gasket supporting moulding extends inwardly over a rear peripheral side of said glass unit.

15. The refrigerator door assembly of claim 12 in which said metal frame inner side wall is formed with an outwardly extending flange in closely adjacent parallel reaction to a rear face of said forward glass pane which together with said other side of said forward frame perimeter portion defines an opening for receiving said moulding.

16. The refrigerator door assembly of claim 15 including adhesive means secured between said outwardly extending flange and a rear face of said forward glass pane.

17. The refrigerator door assembly of claim 12 in which said other side of said forward frame perimeter portion is formed with an inwardly extending flange disposed in rearwardly spaced relation to a rear face of said forward glass pane, and said moulding is formed with an L-shaped leg retained between said flange and said rear face of the forward glass pane.

18. The refrigerator door assembly comprising a metal cabinet frame for mounting in an opening of a refrigerator cabinet, an insulated glass door mounted for pivotal movement relative to said cabinet frame said door including a glass unit having a plurality of glass panes disposed in side-by-side relation including a forward glass pane and a rear glass pane, a spacer interposed between adjacent panes for maintaining said panes in parallel relation with an air space therebetween, and means sealing said air space from the outside environment;

an outer metal frame about the periphery of said glass unit for supporting the weight of said glass unit; and said metal frame including a unitary metallic frame member having a forward perimeter portion substantially in the plane of said forward glass pane disposed in outwardly spaced relation to the peripheral edge of said forward glass pane, said forward perimeter portion does not extend in front of said forward glass pane, thus defining a forwardly opening space about the outer peripheral edge of said forward glass pane and a rear portion extending inwardly behind said forward glass pane and rearwardly to a location in outwardly adjacent relation to the peripheral edge of said rear pane, and a moulding disposed within said space between said forward frame perimeter portion and the peripheral edge of said forward glass pane.

19. The refrigerator door assembly of claim 18 including adhesive means between said pacer and metal frame for securing said glass unit within said metal frame.

20. The refrigerator door assembly of claim 19 including masking means affixed to an inside face of said forward glass pane about the periphery thereof for preventing viewing of said spacer, said rear metal frame portion, and said adhesive through said forward glass panes from a front side thereof while permitting unobstructed viewing of the interior of the refrigerator cabinet within which said door assembly is mounted.

21. The refrigerator door assembly of claim 20 including an intermediate pane disposed between said forward and rear glass panes, and said forward glass pane extends outwardly a greater distance than said rear and intermediate glass panes.

22. The refrigerator door assembly of claim 21 in which said rear metal frame portion is disposed outwardly of the peripheral edges of said intermediate and rear glass panes.

23. The refrigerator door assembly of claim 22 in which said forward and rear glass panes each have peripheral portions extending outwardly beyond said spacer in contact with said adhesive means.

24. The refrigerator door assembly comprising a metal cabinet frame for mounting in an opening of a refrigerator cabinet, an insulated glass door mounted for pivotal movement relative to said cabinet frame said door including a glass unit having a plurality of glass panes disposed in side-by-side relation including a forward glass pane and a rear glass pane, a spacer interposed between adjacent panes for maintaining said panes in parallel relation with an air space therebetween;

an outer metal frame about the periphery of said glass unit for supporting the weight of said glass unit;

adhesive means securing said glass unit within said metal frame;

said forward glass pane extending substantially to the outer perimeter of said door; and said metal frame having a forward perimeter portion substantially in the plane of said forward glass pane, said forward perimeter portion does not extend in front of said forward glass pane;

masking means on an inside face of said forward glass pane about the periphery thereof for preventing viewing of said adhesive and spacer through said forward glass pane from a front side thereof while permitting unobstructed viewing of the interior of the refrigerator cabinet within which said door assembly is mounted.

25. The refrigerator door assembly of claim 24 in which said outer metal frame has a relatively narrow forward perimeter portion disposed immediately adjacent the outer peripheral edge of said forward glass panes.

26. The refrigerator door assembly of claim 25 in which said forward glass pane extends outwardly a greater distance than said rear glass pane.

27. The of claim 26 in which said outer metal frame has a rear portion extending inwardly behind said forward glass pane and rearwardly to a location adjacent the outer peripheral edge of said rear pane.

28. The refrigerator door assembly comprising a metal cabinet frame for mounting in an opening of a refrigerator cabinet, an insulated glass door mounted for movement relative to said cabinet frame, said glass door comprising an insulated glass unit having a plurality of glass panes disposed in side-by-side relation and including a forward pane and a rear pane, a metal spacer interposed between adjacent panes for maintaining said panes in parallel relation with an air space therebetween, an outer metal door frame about the periphery of said glass unit for supporting the weight of said glass unit, means securing said glass unit within said metal door frame, said forward glass pane being of larger size and having a portion extending outwardly a greater distance than said rear pane, said metal frame having a forward perimeter portion substantially int he plane of said forward glass pane, said forward perimeter portion does not extend in front of said forward glass pane; and masking means on an inside face of said forward glass pane about the periphery thereof for preventing viewing of said securing means and spacer through said forward glass pane from a front side thereof while permitting unobstructed viewing of the interior of the refrigerator cabinet within which said door assembly is mounted.

29. The refrigerator door assembly of claim 28 which said forward glass pane extends substantially to the outer perimeter of said door.

30. The refrigerator door assembly of claim 29 in which said outer metal door frame has a relatively narrow forward perimeter portion disposed immediately adjacent the outer peripheral edge of said forward glass pane.

31. The refrigerator door assembly of claim 29 in which said outer metal door frame has a rear portion extending inwardly behind said forward glass pane.

32. The refrigerator door assembly of claim 28 in which said outer metal frame is disposed outwardly of the peripheral edge of said rear pane and rearwardly of said outwardly extending portion of said forward frame.

33. The refrigerator door assembly of claim 28 including an intermediate pane disposed between said forward and rear panes, and said outer metal frame being disposed outwardly of the peripheral edges of said intermediate and rear panes and rearwardly of said outwardly extending portion of said forward pane.

* * * * *